United States Patent [19]

Buice

[11] Patent Number: 4,627,388

[45] Date of Patent: Dec. 9, 1986

[54] COMBUSTION OF HALOGENATED HYDROCARBONS WITH HEAT RECOVERY

[75] Inventor: Jack E. Buice, Lake Jackson, Tex.

[73] Assignee: The Dow Chemical Company, Midland, Mich.

[21] Appl. No.: 757,224

[22] Filed: Jul. 22, 1985

[51] Int. Cl.[4] ..... F22B 7/12

[52] U.S. Cl. ..... 122/149; 110/234

[58] Field of Search ..... 122/149, 47, 151, 150; 110/238, 234; 431/5

[56] References Cited

U.S. PATENT DOCUMENTS

| | | | |
|---|---|---|---|
| 2,287,057 | 6/1942 | Page | 122/149 |
| 2,576,053 | 11/1951 | Toner | 122/149 |
| 4,195,596 | 4/1980 | Scheifley et al. | 122/149 |
| 4,384,549 | 5/1983 | Enga | 122/149 |

*Primary Examiner*—Edward G. Favors

*Attorney, Agent, or Firm*—Walter J. Lee

[57] ABSTRACT

Halogenated hydrocarbon waste materials are burned in a horizontal fire tube boiler. In the disclosed and illustrated embodiments, liquid and/or gaseous waste of highly chlorinated hydrocarbons (often, very inert content) are input along with a flow of fuel oil or gas as required to increase combustion temperature. While high combustion temperatures are achieved, a stable flame front is established. A refractory lined combustion chamber of substantial length is incorporated to contain the flame front near adiabatic conditions for sufficient dwell time so that the combustion gases leaving the vicinity achieve near complete combustion. Before entering the water jacket boiler furnace tube the temperature of the flue gas is dropped to a level enabling the use of standard materials of construction of the tube sheets of the boiler, where the fire tube boiler is most vulnerable to corrosion from excessive temperatures and condensation of chlorinated hydrocarbons reacting on the interior thereof. The tube sheet boiler permits burning of halogenated hydrocarbon waste with minimal support fuel requirements to yield flue gas containing exceptionally high hydrogen chloride concentration.

16 Claims, 2 Drawing Figures

COMBUSTION OF HALOGENATED HYDROCARBONS WITH HEAT RECOVERY

FIELD OF THE INVENTION

This invention relates generally to the recovery of heat from the disposal incineration of liquid waste and off-gases and in particular those liquid wastes and off-gases containing halogenated hydrocarbons. More specifically, this invention relates to a fire tube boiler system of particular design for achieving efficient incineration of waste feeds containing more highly chlorinated hydrocarbons of lower fuel value than is typically the case.

BACKGROUND OF THE DISCLOSURE

Halogenated hydrocarbon materials are burned in an internally fired horizontal fire tube boiler and the heat of combustion is extracted to produce saturated steam. Halogen values are recovered from the combustion of waste liquids and gases, such as by being absorbed in water. For efficient reclamation of halogen values combustion from highly chlorinated, low fuel value materials should occur at or near adiabatic conditions as possible and at minimal excess oxygen required for combustion. When more highly chlorinated hydrocarbon waste is incinerated, typically which is of lower fuel value, additional fuel feed is necessary for efficient combustion and the combustion temperature is typically higher than is normal for such fire tube boilers. The varying physical and chemical properties of waste feeds, corrosiveness of their combustion products, and the extreme operating temperature required for the effective destruction of toxic substances makes heat recovery a challenging problem. It has been found that commercial packaged steam boilers and incinerators equipped with conventional steam generating heat exchangers have certain deficiencies if fired with liquid waste and off-gases containing halogenated hydrocarbons. The substantially greater heat required for efficient combustion and the excessively corrosive nature of the flue gas generated by combustion have detrimental effect on the structure of boiler apparatus. The tube sheets of tube sheet boilers, when composed of conventional metals such as carbon steel are destroyed by corrosion by a relatively short period of time, requiring exceptional high maintenance cost for the equipment. Under circumstances where the fire tube boilers incorporate more exotic metals for corrosion resistance, the cost of the boiler itself becomes disadvantageously high.

It is considered desirable to utilize commercially packaged fire tube boilers for destruction of halogenated hydrocarbons and to utilize conventional end sheet metal material in order that boiler cost will remain as low as possible. It is also desirable however to provide suitable modifications which render standard fire tube boilers efficient for combustion of highly halogenated hydrocarbons.

When utilizing commercial fire tube boilers for incineration of highly chlorinated hydrocarbon waste materials it has been found that the volume of the combustion chamber (furnace) is too small to contain the typically larger flame that is needed and to provide sufficient residence time in the combustion chamber for the combustion of such wastes. Also these waste materials often have undesirable physical properties to make uniform feed control and atomization of the liquid into fine droplets difficult. As a result, the flame is unstable and is of such length that its contact with the refractory lining and/or metal heat transfer surfaces of the boiler causes failures or significantly reduces the service life of the boiler.

It is also known that liquid wastes of highly chlorinated hydrocarbons and off-gases have high quantity of inert materials and as a result have low caloric values. Firing these waste materials in the water cooled furnace of a packaged fire tube boiler ordinarily requires a high proportion of support fuel, such as natural gas or fuel oil, to waste feed to maintain a stable flame and sustain combustion for complete destruction of the organic waste.

In some cases an incinerator equipped with a conventional steam generating exchanger of the "straight through" variety of the general nature set forth in U.S. Pat. No. 4,198,384 may be employed to resolve the above problems regarding packaged fire tube boilers, but this type of incinerator also has an inherent problem. Extreme combustion temperatures of 1000° C. to 1800° C. (1200° C. to 1500° C. most common in practice) are required to successfully destroy toxic substances to a level required by government regulations. The front tube section of these straight through exchanger is subject to rapid failure when directly exposed to the hot combustion gases and the radiant heat from the refractory walls of the furnace. Special designs to reduce the tube sheet temperature and special materials of construction are required for this system to be successful. Obviously, special designs and exotic materials significantly increase the cost of straight through incinerators of this character and therefore render them commercially undesirable.

The present invention utilizes the advantages of a refractory lined furnace and also employs a large water cooled furnace interconnected with a fire tube boiler to reduce the combustion gas temperature in the boiler to a level sufficiently low (1000° C. or so) that standard materials of construction and design may be employed for the tube sheets of the steam generator, thereby resulting in an incinerator construction of reasonable cost and efficient service-ability.

Very useful fire-tube boiler structures are set forth in U.S. Pat. Nos. 4,125,593, 4,195,596 and 4,476,791. Halogenated hydrocarbon materials from a waste feed can be routinely combusted in these fire-tube boiler structures. The present disclosure sets forth an improvement to such fire tube boiler systems wherein more highly chlorinated hydrocarbons of lower fuel value can be efficiently combusted for HCl recovery and steam generation through the use of standard boiler materials that are not diminished by the excessive corrosion that ordinarily occurs. Thus, this disclosure relates to a combustion chamber and fire tube boiler assembly which enables the incidental recovery of heat resulting from incineration of either liquid or gas waste materials (typically halogenated hydrocarbons) all accomplished in a manner satisfactory to regulatory authorities relating to such disposal.

SUMMARY OF THE INVENTION

With these problems in mind, the present invention is directed to a halogenated hydrocarbon incinerator wherein heat is extracted from an irregular and varied feed of highly halogenated liquid or gaseous hydrocarbon waste which may have minimal caloric value, thereby enabling a water cooled horizontal fire tube boiler to form halogen acids and saturated steam. Internal corrosion of the metal surfaces in contact with the hot combustion gases is avoided by controlling the temperature of the saturated steam produced by the boiler. The corrosive effect of gas in contact with the internal or working surfaces of the incinerator, especially the tube sheets is thus minimized. The incinerator of this invention provides more residence dwell time of waste material in the combustion chamber to ensure that the waste material is completely incinerated within the length of the chamber. Also the structure of the combustion chamber is such as to develop efficient burning of waste materials with minimal support fuel producing a flue gas of higher chlorine concentration (HCl). The combustion chamber is also designed to ensure that the tube sheets, which are constructed of ordinary tube sheet material, are subjected to flue gas temperature in the range of about 50% of that typically occurring when wastes of this character are incinerated. In light of the variations in physical properties of the waste materials and irregular atomization, the flame is typically unstable in temperature, size and location. The improved structure of this invention successfully contains a flame front which moves, which flame may extend so far into a conventional boiler as to otherwise damage refractory lining and/or metal heat transfer surfaces and tube support sheets.

If an incinerating fuel supply is normally added, an extremely high combustion temperature of perhaps 1,000° to 1,800° C. can be achieved for successful destruction of toxic substances to obtain an ecologically desirable flue stream. The incinerator structure of this invention accommodates the higher temperature and enlarged flame front while minimizing risk to the refractory and metal heat transfer surfaces. Thus, the addition of a combustion feed flow, the establishments of a stabilized flame front, and the sustaining of relatively high combustion temperatures is effectively accommodated by the incinerator system thereof. The combustion chamber is of a designed dimension correlated with the character of waste material to be incinerated and the fuel necessary to achieve complete combustion of the waste material. The volumetric dimension of the combustion chamber, including its length and width, is determined by the maximum expected volume of the flame in the combustion chamber. The modified combustion chamber or furnace of this invention is particularly constructed so that the horizontal combustion chamber is more elongated and of larger dimension as compared to standard fire tube boilers so that a mix of waste to be combusted (typically a halogenated hydrocarbon gas or liquid) is injected with a feed (natural gas or fuel oil) along with combustion air and steam to establish a stabilized flame front of high temperature within a refractory lined elongate horizontal combustion chamber. Four feeds are provided, one being a supply of fuel and the second being a flow of atomizing fluid, typically air or steam. A third feed is incorporated, namely the liquid and/or gas waste, and the fourth is combustion oxygen and/or air.

A flame front is established within the combustion chamber defined within refractory lined cylindrical housing having an out flow passage. At this juncture, the flame front is established of sufficient size and temperature to insure complete conversion of the waste hydrocarbons. The out-flow therefrom has a reasonably regulated temperature and carries combustion products, the waste products being fully consumed and converted to enable the flue gases to be safely discharged. The combustion chamber is secured to the combustion gas entry portion of a standard fire tube boiler with an elongated flue gas receiving passage in aligned registry with the gas flow passage from the combustion chamber. At the end of the flue gas receiving passage the flow path is reversed as it impinges against a tube sheet. The length of the gas flow passage from the combustion chamber together with the length of the flue gas receiving passage of the boiler permits temperature decrease such that the temperature of the flue gas impinging upon the tube sheet is within an acceptable range for extended service life of the conventional metal tube sheet. Further, the gas flow passage of the combustion chamber is refractory lined and water cooled and extends well into the entrance of the gas receiving passage of the boiler. This feature provides the gas entrance portion of the boiler with efficient protection against elevated temperature during temperature diminishing flow of flue gas into the boiler.

The foregoing describes in summary fashion the apparatus which is described in detail hereinafter. An understanding of the description of the preferred embodiment will be aided and assisted by review of the affixed drawings.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective embodiments.

DETAILED DESCRIPTION OF THE PREFERRED EMBODIMENT

Figure 1:
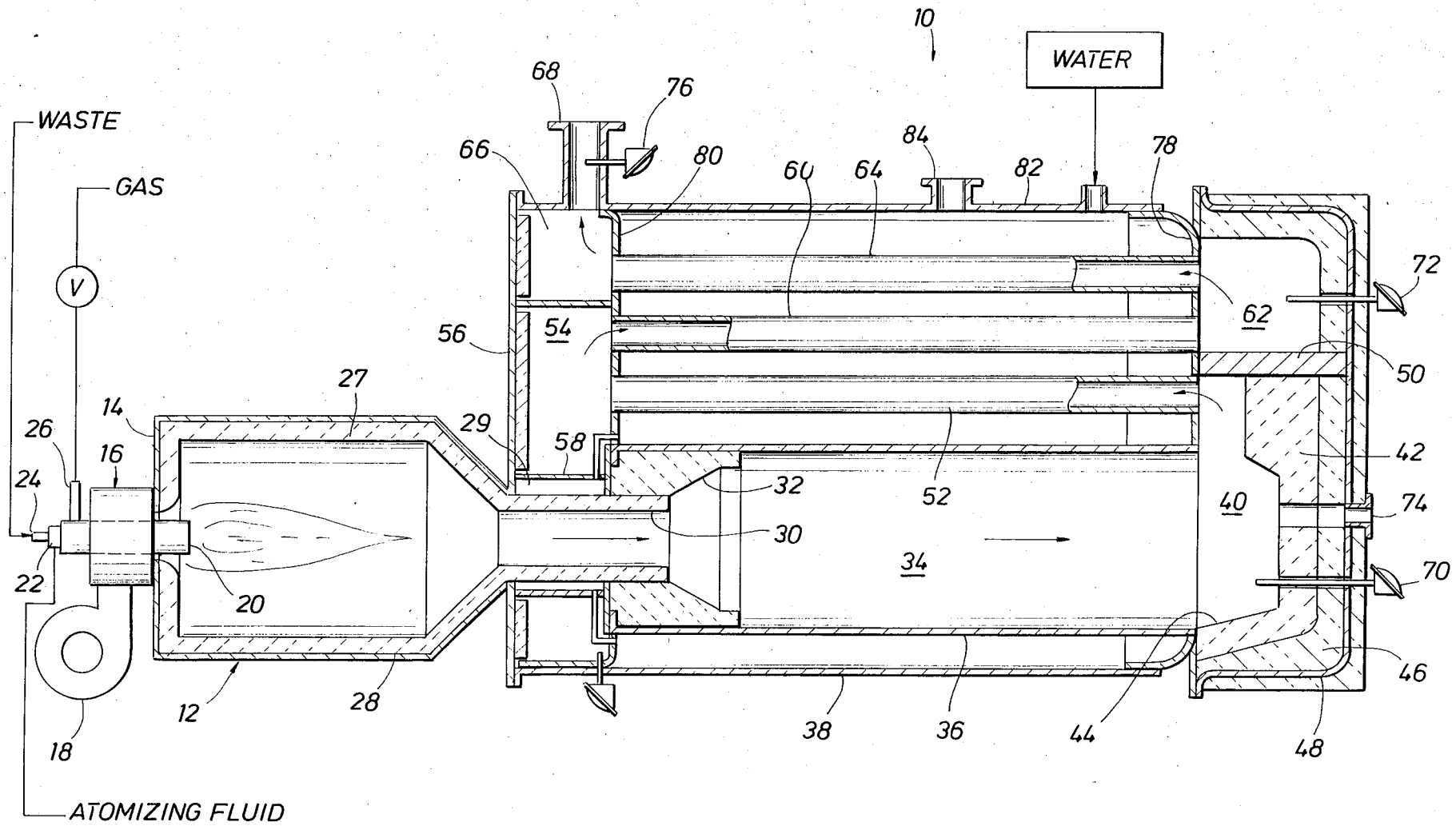
FIG. 1 shows the improved halogenated hydrocarbon incinerator of the present disclosure in sectional view setting forth details of construction.

Attention is first directed to FIG. 1 where the improved incinerator is identified by the numeral 10. The description of the apparatus will begin with that portion of the equipment where the waste is incinerated with atomizing gas, combustion air and fuel, and follows the flow path of the combustion products through the incinerator and out the flue. A sequence of operation will be set forth hereinafter. In very general terms, the numeral 12 identifies a firebox or primary combustion chamber of an elongate generally cylindrical construction which cylindrical configuration is not intended as limiting, since within the spirit and scope hereof the primary combustion chamber may take other suitable forms. The primary combustion chamber has a remote end wall 14. The wall 14 supports a manifold 16 into which a large flow of combustion air is delivered. The air is forced into the manifold 16 by means of a blower 18. An ample volume of air is delivered to assure complete combustion. The numeral 20 identifies a nozzle assembly which ejects a controlled flow of fuel, waste to be combusted and also an atomizing fluid. The nozzle 20 is physically located adjacent the manifold 16 whereby an outflow of combustion air surrounds the plume of atomized vapors coming from the nozzle 20. The nozzle 20 is provided with three feeds. The feed 22 furnishes an atomizing fluid which is either air or steam. It defines an emerging spray extending from the nozzle 20 which supports and carries fuel and waste for combustion. Fuel is delivered through a conduit 26 for the nozzle 20 and is ejected from the nozzle along with the atomizing fluid. A flow of waste (either liquid or gaseous delivered from a suitable waste source through a typical shut off valve) is also delivered through a conduit 24.

In general terms, the fuel may be fuel oil or natural gas. The waste can be gas or liquid, and typically incorporates a significant volume of halogenated hydrocarbons for combustion and disposal. Both the waste and the fuel are delivered to the atomizing fluid flow and all are comingled as they flow at relatively high velocity in an atomized dispersal from the nozzle 20. They are surrounded by a flow of combustion air. By means of a pilot (not shown), the combustion products are ignited and the flame is established within the primary combustion chamber 12. The nozzle assembly and external connective lines are represented somewhat schematically. Typical prepackaged nozzle assemblies can be purchased for the primary combustion chamber 12 and one source is Trane Thermal Company of Pennsylvania.

The primary combustion chamber includes the back wall 14 which supports, thereby centering, the nozzle 20 and consequently supports and locates the flame front within the primary combustion chamber 12. The primary combustion chamber has an elongate cylindrical body 28. It is sized so that the remote end of the flame front is contained within the cylindrical volume defining the primary combustion chamber 12. The physical dimensions of the primary combustion chamber 12 are sized according to the character of waste to be incinerated. Generally, the higher the volume of halogenated hydrocarbons of the waste feed, the larger the primary combustion chamber to ensure adequate dwell time of the waste products in the primary combustion chamber for complete combustion. The primary combustion chamber terminates with outlet conduit or passage 30. Passage 30, being the discharge passage of the primary combustion chamber, is subject to elevated temperature immediately downstream of the flame front. Passage 30 is therefore lined with refractory material 27 which extends in contiguous relation from the refractory lining of the primary combustion chamber 12 to a location well inside the inlet passage or chamber 34 of the fire tube boiler 10. For cooling of the flue gas passing through the passage 30 the refractory lining 27 is surrounded by a cooling chamber 29 through which cooling water flows. The cooling chamber is fed from a water supply or any other suitable supply of coolant medium. While flowing from the primary combustion chamber through the passage 30 the temperature of the flue gas is decreased from a 1600° C. to 1800° C. flame temperature range to a temperature level of about 1100° C. Further cooling of the flue gas is achieved in the boiler passages by virtue of the water jacket cooling system thereof. A halogenated waste destruction efficiency of 99.99% will result, and an overall combustion efficiently of about 99.9% is obtained. This destruction efficiency is advantageously accomplished with less fuel gas as compared with standard boiler systems and with temperature maintenance within the tolerance range of carbon steel. Efficient waste destruction is achieved and more importantly, efficient chlorine recovery, a prime consideration, is effectively achieved. Heat recovery, an ancillary requirement, is also efficiently accomplished. Passage 30 opens into a flared transition member 32 which then connects with a horizontal flue gas receiving chamber 34. As a matter of scale, the primary combustion chamber 12 and passage 30 can be close in size as in FIG. 2 and hence avoid the transition at 32. The chamber 34 is serially connected downstream from the primary combustion chamber 12 and hence can, in one sense, be called a horizontal or secondary combustion chamber. In that sense, the combustion begins in the combustion chamber 12 and may be substantially complete therein; on the other hand, there may be individual droplets which are ultimately combusted in the secondary combustion chamber 34. The flame front can extend into the transition passage 30 but it is intended to be contained within the primary combustion chamber 12. As will be appreciated, there is a temperature gradient indicative of the fact that most of the combustion occurs within the combustion chamber 12. For this reason, the secondary combustion chamber 34 is less a combustion chamber, but it is aligned with chamber 12 to expand the effective combustion chamber size and capacity to thereby enable the outflow of combustion gases to escape the immediate combustion chamber area, whereby continued use and operation of the device can be obtained without boiler destruction.

Some emphasis should be placed on the materials used in construction of this apparatus. The primary combustion chamber 12 is preferably made of a high quality ceramic refractory material capable of withstanding at least 2,000° C. Ordinarily, the fuel and air flow are such as to maintain temperatures up to about 1,800° C. Depending on the particular nature of the feed, lower temperatures can be sustained while yet achieving full combustion conversion of the waste products. To insure an ecologically safe discharge at the flue, the maximum temperature required for the most difficult combusted product should be the design criteria for material selection. In this light, a combustion chamber construction with materials capable of handling about 2,000° C. on a sustained basis is sufficient. The ceramic refractory materials used in this area extend through the water jacketed tube 30 to the transition member 32. That is, from the member 32, alternate and less costly materials can be used because the temperature is substantially reduced and the flue gas is not highly corrosive.

Assuming a design criteria of 2,000° C. in the primary combustion chamber, the secondary combustion chamber 34 can be designed for a lesser temperature say in the range of from 900° C. to 1500° C. To this end, it is permissible to use exposed metal surfaces such as special nickel steels. Such alloys can be used to safely resist damage from the temperatures achieved within the chamber 34. Since the device preferably operates at high temperatures to assure substantially complete combustion of the waste, no condensation occurs within the chamber 34. The chamber 34 is thus defined by the surrounding metal wall 36. Typically, this is constructed as a circular member which is concentric relative to the primary combustion chamber 12 and which has a relatively large cross-sectional area. It is supported by a surrounding housing 38. The space around the wall 36 is water filled as explained below. The tubular member 36 extends to and terminates at a return space 40. The space 40 is a return space defined within a specially shaped member made of refractory materials and identified at 42. The structure 42 has an internal face 44 which is curved and shaped to route the gas flow through a gentle U-turn. The ceramic refractory material 42 is supported by a surrounding second refractory material 46 which is in turn supported by a metal cap 48. The cap 48 is a structural member terminating in a circular flange, having sufficient strength and structural integrity to hold and support the various ceramic members which are affixed to it. By the time gas flow reaches the space 40, the temperature drops under 1000° C. well within the range of efficient serviceability of the carbon steel tube sheets of the boiler.

It will be observed that the end of the incinerator can be removed by removing all of the components supported with the member 48. This can typically be achieved by attaching the member 48 to the remainder of the structure with suitable nuts and bolts (not shown). In very general terms, the large gaseous flow at elevated temperature turns through the return space 40 and is deflected by the overhead barrier 50. The gaseous flow is directed toward a set of return tubes 52. There are several return tubes which extend parallel to and above the chamber 34. They open into a flow chamber 54 at the opposite end. In the flow chamber 54, the metal walls 56 and 58 define the flow chamber such that the flowing gases are directed through a U-turn, flowing through return tubes 60. The tubes 60 in turn communicate with another return space 62 and redirect the flowing gases into another set of tubes 64. These tubes open into a manifold 66 and are discharged through a flue 68. As will be observed, the wall 56 defines one end of the structure. It is covered with insulated materials such as refractory material because there is direct gas impingement against this wall. The gas flow at the left hand end is thus directed against the wall 56, accomplishes a full turn, ultimately arriving in the manifold 66 to be discharged through the flue 68. This is similar to the flow pattern established at the right hand end where the gas is directed through two separate 180° turns. As will be observed in common between both ends of the equipment, a metal structure supporting ceramic refractory material directs the gas to turn along the paths as described.

Several features of this apparatus should be noted. The right hand end comprises a separable assembly for servicing the equipment. To obtain some information on the continued successful operation of the device, a thermocouple 70 is incorporated and a similar thermocouple 72 is likewise included. They measure and indicate the temperatures in different portions of the equipment. If desired, a sight glass 74 is likewise included, being located to view the chamber 34 and the combustion chamber 12. This view through the sight glass coupled with the two thermocouples helps an operator know the condition within the equipment. In like fashion, a similar thermocouple 76 is incorporated at the flue.

As will be understood from the materials indicated in the drawing, the structure including the tube sheets and return tubes is primarily fabricated of carbon steel and is not particularly able to resist excessive heat and corrosion damage. The several tubes 52, 60 and 64 are parallel to one another and are supported by tube sheets. At the right had end, a tube sheet 78 supports the tubes in parallel alignment with one another. In like fashion, a similar tube sheet 80 at the left end supports the tubes so that they are arranged in parallel ranks. As will be understood, there are several return tubes 52 having an aggregate cross-sectional area to suitably conduct the gas flow emerging from the primary combustion chamber 12. No constriction arises because the number of tubes 52 is selected to insure that the back pressure is held to a minimum. In like fashion, the tubes 60 and 64 are likewise replicated to assure an adequate gas flow route.

The several return tubes supported by the tube sheets cooperate with a top wall 82 and outlet 84 to define a steam chest. Specifically, water is introduced and fills the steam chest. Water is added and steam is recovered through the port 84. The water is maintained to a depth of at least three inches over the top tubes. Steam is delivered through the port 84 at a suitable pressure and temperature for use elsewhere. Accordingly, water fills the chamber or cavity fully surrounding the wall 36 defining the chamber 34 and rising to a height as described and fully enclosing the secondary combustion chamber 34 and the return tubes 52, 60 and 64. A suitable water supply control system (not shown) delivers a sufficient flow of water whereby steam is discharged and can be used for utility recovery. The water is heated by heat transferred through the chamber 36 and all the tubes above it. The steam in the surrounding steam chest stabilizes the metal parts temperature.

The flue gas discharged from the apparatus has a temperature of perhaps 15° C. to 50° C. higher than the steam temperature. It is discharged at the outlet 68, and is preferably delivered to a device which scrubs the flue gas to remove vaporous hydrochloric acid.

Figure 2:
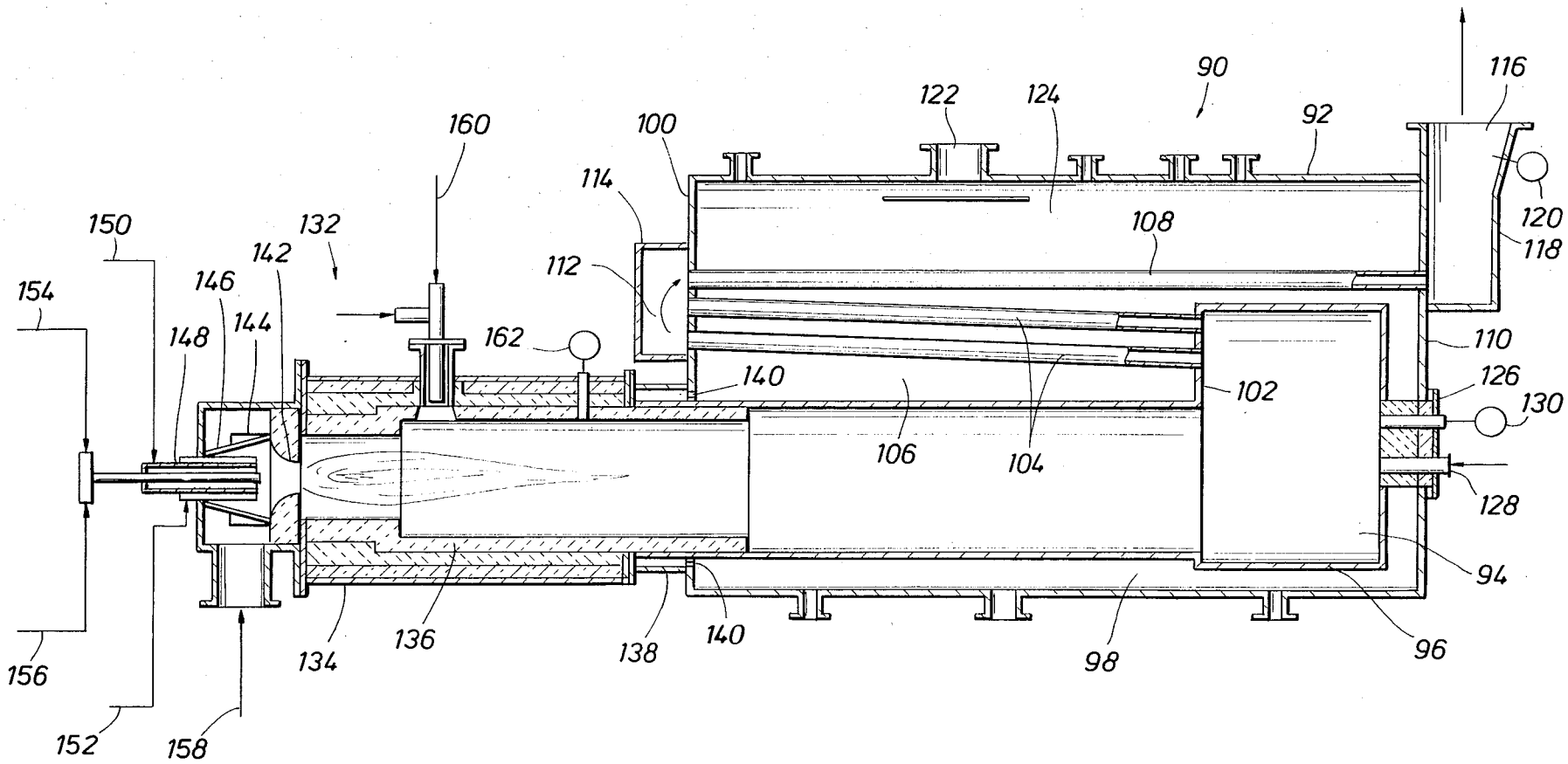
FIG. 2 is a sectional view of an improved halogenated hydrocarbon incinerator representing an alternate boiler construction embodiment of this invention.

Referring now to FIG. 2 of the drawings a fire tube boiler is illustrated generally at 90 having an external boiler shell 92 which is formed of conventional, low cost material such as carbon steel provided with an exterior installation. The boiler 90 forms a secondary combustion chamber 94 having a carbon steel lining 96 surrounded by a water jacket 98. The boiler structure defines a front tube sheet 100 and a combustion chamber tube sheet 102 which provide structural support for a plurality of parallel second pass tube members 104. These tube members are composed of standard low cost material such as carbon steel and function to conduct the flow of flue gas from the combustion chamber 94 through a boiler water chamber 106. Water in the boiler chamber is maintained at a level above the tube members. A plurality of third pass tube members 108 are supported at one end by tube sheet 100 and at the opposite end by a rear tube sheet 110. The boiler tubes 104 and 108 communicate with a flue chamber 112 formed by a flue chamber wall structure 114 connected to the tube sheets 100. Within the flue chamber 112 flow from the second pass tube members 104 reverses direction and enters third pass tube members 108. Exiting flue gas from the third pass tube members 108 enters a gas outlet passage 116 defined by a rear flue chamber housing 118 connected to the rear tube sheet 110. Combustion product gases at the outlet passage 116 will be in the range of from 15° C. to 35° C. above saturated steam temperature. This temperature is measured by a temperature sensor 120.

The boiler water chamber 106 is provided with a steam outlet 122 which is in communication with a steam chamber 124 at the upper portion of the boiler.

At the rear end of the boiler a refractory plug 126 is provided to close a manway opening of the combustion chamber. This refractory plug includes a site glass 128 for visual inspection of the combustion chamber and a temperature sensor 130 for detection of flue gas temperature in the secondary combustion chamber.

The fire tube boiler 90 described above is of fairly conventional nature and being composed of low cost materials such as carbon steel, it will not typically withstand significantly elevated temperatures such as are present during combustion of highly halogenated hydrocarbon waste materials and it will not withstand excessive corrosion which typically occurs when carbon steel materials are in contact with flue gas at significantly elevated temperatures. Accordingly, the boiler system 90 is modified to provide an elongated burner or primary combustion chamber, illustrated generally at 132, which extends forwardly of the front tube sheet 100 of the boiler. The primary combustion chamber 132 is defined by a housing structure 134 which is lined with a high temperature refractory material 136 which is capable of withstanding flame front temperature in the order of 2000° C. The refractory lining is designed to minimize heat losses thus allowing combustion to approach adiabatic conditions to allow combustion of waste material having low fuel value feed with minimum support fuel. The initial portion of the primary combustion chamber 132 is formed by a fire brick material having high alumina content. This fire brick material is surrounded by an insulating refractory material which provides an acid resistant membrane. The exterior housing 134 is also insulated and provides a wind-/rain shield to insulate the burner mechanism from the effects of weather.

At the connection of the primary combustion chamber 132 with the front tube sheet 100 the refractory lining extends past the front tube sheet well into the secondary combustion chamber 94 thus protecting carbon steel metal surfaces from corrosion by high temperature flue gas which may be in the order of 1100° C. to 1550° C. at the inlet throat of the fire tube boiler. A water jacket 138 is secured to the front tube sheet and defines a coolant chamber or "wet throat" which is in communication with boiler chamber 106 via openings 140. This wet throat boiler furnished extension maintains the carbon steel at the desired temperature in the transistion of flue gas from the refractory lined combustion chamber to the water walled boiler furnace.

At the front end of the primary combustion chamber mechanism 132 is provided an air nozzle 142 such as may be composed of Hastelloy-C or Inconel. To the burner air nozzle 142 is connected a combustion air baffle 144 and a plurality of combustion air swirl vanes 146. A liquid and gas feed injection nozzle is supportive by the air swirl vanes and includes an appropriate tip for air atomization. A Hastelloy-C tip may be provided for atomizing the liquid and gas feed with air and a tantalum tip may be provided for steam atomization. The nozzle is provided with a feed line 150 for an atomizing fluid (steam or air) and a feed line 152 for combustable process or fuel gas. A supply line 154 is provided for RC1 and HC (chlorinated waste mixed with various hydrocarbons) and a supply line 156 is provided for fuel oil. Another line 158 is provided for supply of combustion air to the system which is appropriately mixed by combustion air swirl vanes with the waste RC1 and fuel feeds. Another fuel supply 160 (mixed with air) is provided in the event inert waste gas contaminated with RC1 must be boosted in temperature. The temperature of the flame front in the combustion chamber 132 is monitored by means of a temperature sensor 162.

From the foregoing it is apparent that the present invention provides an enhanced device and method for the combustion of chlorinated hydrocarbons for the recovery of the chlorine as muriatic acid with energy recovery as steam. Refitting a packaged fire tube boiler that has been modified and operated at conditions to prevent failure from corrosion from a burner of a special design to accomplish waste combustion with a minimum loss of heat within a minimum volume can reduce support fuel requirements in the range of from 25% to 50%. Reduction of support fuel requirements can significantly increase the HCl concentration in the combustion product gases which enhance the recovery of HCl. Also, reducing support fuel requirements can significantly reduce the size of the equipment and the operating costs because air requirements can be reduced accordingly.

In accordance with the foregoing, it is evident that standard or conventional direct-fired packaged fire tube boilers modified to burn chlorinated hydrocarbons (RC1 and HC) can successfully burn certain chlorinated hydrocarbons having physical and/or chemical properties that require a longer residence time than that provided by standard fire tube boiler design. Refitting the modified boiler with a burner of special design for the specific requirements (turbulance, residence time and temperature) of a particular chlorinated hydrocarbon feed waste, off-spec products, by-products, spent solvents, etc) can accomplish product and energy recovery to a greater extent than was previously possible.

The burner design of standard or conventional direct-fire package fire tube boilers can be modified according to the present invention to burn chlorinated hydrocarbons and thus provide only limited alternatives for introducing in multiple liquid and gaseous chlorinated hydrocarbon feeds of various properties and fuel quality. Refitting the boiler device with a burner of special design, allows the injection of essentially inert gases contaminated with small amounts of RC1s and HC, separate and apart from the support fuel and fuel quality RC1 feeds, for efficient destruction of these hazardous contaminants while maintaining safe and reliable combustion control. The use of a boiler device for the recovery of energy in the form of steam from the combustion of RC1s also serves to quench the hot combustion gases for HCl recovery in downstream absorber equipment. The use of a boiler for cooling the combustion gases, instead of an evaporated quench system of conventional RC1 burner design, enhances the recovery of HCls as a more concentrated muriatic acid product, since there is only water vapor from combustion air and as a product of combustion to contend with in the HCl absorber design.

A particularly important advantage is the possibility of introducing completely inert gas into the flame for combustion and conversion. Cost of operation is thus reduced as the volumetric flow is reduced (even when disposing of inert gas) whereby steam recovery supplies part of the cost of operation. If desired, hydrochloric acid recovery from the flue gas discharge by suitable connected downstream equipment enables more economic recovery of the discharged flue gas.

While the foregoing is directed to the preferred embodiment, the scope of the invention is determined by the claims which follow:

What is claimed is:

1. A water-cooled, horizontal fire-tube boiler having an affixed end section, a boiler section, and a second end section, which comprises in combination:

(a) a boiler section comprising a generally closed shell having a vertically disposed metal tube-sheet at each end, said shell holding water between said ends, a relatively long secondary combustion chamber extending along the length of, and within, said shell, and communicating through said tube-sheets, a plurality of relatively small metal return-tubes extending the length of, and within, the boiler shell and communicating through said tube-sheets, the secondary combustion chamber and the return-tubes being in spaced horizontal relationship;

(b) wherein said boiler section defines a folded multi-segment flue gas discharge path therethrough;

(c) a front end nozzle section adjacent a confined primary combustion chamber for containing combustion gases, said primary combustion chamber communicating with said secondary combustion chamber and into said return-tubes, and having feed means for feeding air, supplemental fuel, and halogenated hydrocarbons into a burner nozzle within the primary combustion chamber;

(d) means for blowing air past said nozzle to define a flame front having a temperature in the range of from about 1,000° C. to about 1,800° C. to combust halogenated hydrocarbons;

(e) said primary combustion chamber having an elongate extent sufficient to enclose therein the flame front, and wherein said primary combustion chamber terminates opposite said burner nozzle in an aligned and streamlined relation therewith, insulation covered wall means defining an outlet directing flue gas flow from said primary combustion chamber into said secondary combustion chamber;

(f) said outlet being sufficiently spaced from the flame front and sufficiently long that flue gas temperature at the end of said secondary combustion chamber is less than 1,000° C. at entry into said folded multi-segment flue gas discharge path;

(g) end section means comprising a confined space for containing combustion gases, said space communicating with said secondary combustion chamber and said return-tubes and defining a portion of said folded multi-segment flue gas discharge path;

(h) said shell and said end section means having surfaces, except for the tube-sheet surfaces, which are exposed to the combustion gases when the boiler is in operation, made of corrosion-resistant material or covered with an amount of insulation predetermined to maintain the temperature of such surfaces within a predetermined temperature range during operation;

(i) means for supplying water into said shell;

(j) a means for removing steam from said shell; and (k) flue means for removing combustion gases from one of the end sections.

2. The apparatus of claim 1 wherein said primary combustion chamber includes an elongate cylindrical side wall opening into said chamber, and including auxiliary waste injector nozzle means into said primary combustion chamber located on said side wall.

3. The apparatus of claim 1 wherein said secondary combustion chamber comprises an elongate circular structure internally lined with refractory material, and which has a lengthwise extent in conjunction with said primary combustion chamber to define a region of elevated temperature sufficiently long to obtain a dwell time over a specified minimum whereupon the waste halogenated hydrocarbons are oxidized before turning into said multi-segment flue gas discharge path.

4. The apparatus of claim 3 wherein said primary combustion chamber includes a circular end portion supporting said nozzle, said nozzle location determining alignment of the fire front in said primary combustion chamber and said secondary combustion chamber, and wherein said nozzle, in conjunction with a specified gas flow therealong, forms a flame front discharging waste flue gas at less than 1000° C. into a first U-turn in the multi-segmented flue gas flow path.

5. The apparatus of claim 4 including a nickel alloy metal member defining said secondary combustion chamber, and wherein said combustion chamber is encircled by water on the exterior thereof and within said secondary shell.

6. The apparatus of claim 4 including first and second serially arranged sets of return tubes in sufficient total cross-sectional area to flow flue gas to said flue means.

7. The apparatus of claim 4 including transition means connected between said primary combustion chamber and said secondary combustion chamber, said transition means tapering between two circular ends, and being formed of refractory material.

8. The apparatus of claim 4 wherein said primary combustion chamber includes a surrounding cylindrical wall supporting auxilliary nozzle means for injecting a flow of inert halogenated hydrocarbon waste into the flow from said nozzle for combustion before emerging from the flame front.

9. The apparatus of claim 8 including means for delivery of atomizing fluid with said halogenated hydrocarbon waste.

10. A water-cooled horizontal fire tube boiler for incineration of waste materials which may contain highly chlorinated hydrocarbons, comprising:

(a) boiler means having a water coolant chamber and carbon steel tube sheets supporting a plurality of water cooled gas flow tubes, said boiler means having metal structure defining an elongated secondary combustion chamber and having said water coolant chamber disposed thereabout;

(b) an elongated primary combustion chamber being connected to one end portion of said boiler means and defining flue gas transition means in aligned registry with said secondary combustion chamber, said primary combustion chamber being of a physical dimension to contain a waste incinerating flame of maximum expected dimension for substantially adiabatic incineration of a predetermined range of waste feeds;

(c) said primary combustion chamber having a refractory lining of a character sufficient to withstand temperatures above the maximum expected temperature of said waste incinerating flame, said refractory lining also forming a temperature resistant refractory lining for said flue gas transition means;

(d) means cooling said flue gas transition means and reducing the temperature of flue gas flowing from said secondary combustion chamber to a sufficiently decreased temperature range to minimize corrosion of said carbon steel tube sheets; and (e) incinerator feed means supplying flame feeding components to said primary combustion chamber and maintaining said waste incinerating flame.

11. Apparatus as recited in claim 10, wherein said flue gas transition means is of reduced cross-sectional dimension as compared to the cross-sectional dimension of said primary combustion chamber, thereby forming a restriction between said primary combustion chamber and said secondary combustion chamber of said boiler.

12. Apparatus as recited in claim 11, wherein a water jacket is disposed about said flue gas transition means and forms a transition coolant chamber for said flue gas transition means, said transition coolant chamber being in communication with said water coolant chamber.

13. Apparatus as recited in claim 10, wherein said flue gas transition means is of substantially the same cross-sectional dimension as the cross-sectional dimension of said secondary combustion chamber of said boiler.

14. Apparatus as recited in claim 13, wherein a water jacket is disposed about said flue gas transition means and forms a transition coolant chamber for said flue gas transition means, said transition coolant chamber being in communication with said water coolant chamber.

15. Apparatus as recited in claim 10, wherein said primary combustion chamber includes feed means for selectively feeding waste material, air, fuel and steam as needed to maintain an incineration flame in said primary combustion chamber in the range of from about 1000° C. to about 1800° C. for combustion of halogenated hydrocarbons.

16. Apparatus as recited in claim 10, wherein said primary combustion chamber is of generally cylindrical configuration and is sufficiently elongate to confine therein a significantly large incineration flame to achieve substantially complete combustion of a feed including halogenated hydrocarbons.

* * * * *